US006692194B2

(12) United States Patent
Strand

(10) Patent No.: US 6,692,194 B2
(45) Date of Patent: Feb. 17, 2004

(54) METHOD FOR INSTALLING A CONDUCTOR CASING THROUGH A SUCTION SUBSTRUCTURE

(76) Inventor: Harald Strand, Skoghaug 5, Ålgård (NO), N-4330

( * ) Notice: Subject to any disclaimer, the term of this patent is extended or adjusted under 35 U.S.C. 154(b) by 0 days.

(21) Appl. No.: 10/220,165

(22) PCT Filed: Feb. 21, 2001

(86) PCT No.: PCT/NO01/00062

§ 371 (c)(1),
(2), (4) Date: Aug. 28, 2002

(87) PCT Pub. No.: WO01/65050

PCT Pub. Date: Sep. 7, 2001

(65) Prior Publication Data

US 2003/0029620 A1 Feb. 13, 2003

(30) Foreign Application Priority Data

Feb. 29, 2000 (NO) ..... 20001031

(51) Int. Cl.[7] ..... E02D 5/32; E02D 7/24; B63B 21/27

(52) U.S. Cl. ..... 405/226; 405/227; 405/228; 114/296; 175/7

(58) Field of Search ..... 405/224, 224.2, 405/226, 227, 228; 114/296; 166/350; 175/5, 7

(56) References Cited

U.S. PATENT DOCUMENTS

| | | | | | |
|---|---|---|---|---|---|
| 3,643,446 | A | * | 2/1972 | Mott | 175/7 |
| 3,817,040 | A | * | 6/1974 | Stevens | 405/228 |
| 4,432,671 | A | | 2/1984 | Westra et al. | |
| 4,510,985 | A | | 4/1985 | Arnim, II et al. | |
| 4,558,744 | A | * | 12/1985 | Gibb | 405/226 |
| 4,572,304 | A | * | 2/1986 | Mahar et al. | 175/7 |
| 4,575,282 | A | * | 3/1986 | Pardue et al. | 114/296 |
| 4,830,541 | A | | 5/1989 | Shatto | |
| 5,449,253 | A | | 9/1995 | Roger | |
| 6,196,333 | B1 | * | 3/2001 | Aardal | 175/5 |
| 6,488,446 | B1 | * | 12/2002 | Riemers | 405/224.1 |
| 2002/0081158 | A1 | * | 6/2002 | Strong et al. | 405/232 |

FOREIGN PATENT DOCUMENTS

| | | |
|---|---|---|
| CA | 1179254 | 12/1984 |
| CA | 1194410 | 10/1985 |
| CA | 1248870 | 1/1989 |
| WO | 9957009 | * 11/1999 |

* cited by examiner

*Primary Examiner*—Jong-Suk (James) Lee
(74) *Attorney, Agent, or Firm*—Andrus, Sceales, Starke & Sawall, LLP

(57) ABSTRACT

A suction substructure (2) is for the setting of one or more conductor casing strings (14) in connection with drilling of at least one underwater well, preferably a petroleum well. Use of the suction substructure (2) renders possible the installation of conductor casing by means of known piling technique and by means of a suitable surface vessel, e.g. a suitable boat. The suction substructure (2) consists of a substructure body, which is joined in a pressure sealing manner, and which is shaped with a downwards open end part (8), which is set some way down in the seabed sediments (22). Thereupon water is pumped out of the suction substructure (2), which causes a negative pressure in the suction substructure (2), and where the suction substructure (2) thereby is pressed further down into the seabed sediments (2). The suction substructure (2) is in addition in its upper end fitted with at least one guide opening (10) and possibly an appurtenant guide funnel (12), and an appurtenant releasable and pressure sealing lid (32), and where the guide funnel (12) will be able to guide and give lateral support to a conductor casing string (14) during its subsequent installation.

9 Claims, 5 Drawing Sheets

METHOD FOR INSTALLING A CONDUCTOR CASING THROUGH A SUCTION SUBSTRUCTURE

CROSS REFERENCE TO RELATED APPLICATION

The present application is the U.S. national stage application of International Application PCT/N001/00062, filed Feb. 21, 2001, which international application was published on Sep. 7, 2001 as International Publication WO 01/65050. The International Application claims priority of Norwegian Patent Application 20001031, filed Feb. 29, 2000.

FIELD OF THE INVENTION

The invention concerns a substructure device in the shape of a suction substructure and a method for installing it on and in a waterbed as well as use of the suction substructure in connection with installation of conductor casing for one or more wells, preferably petroleum well(s), in which the installation of suction substructure and drilling of wells are performed from e.g. a floating installation.

BACKGROUND OF THE INVENTION

The background of the invention is the disadvantages of installation and costs often experienced with the use of known substructure devices in connection with the drilling of underwater wells.

KNOWN TECHNIQUE

In connection with known technique the work with a new well is normally started by the drilling of a pilot hole from a drilling installation, e.g. a drilling rig, the hole having a diameter of e.g. 36", down to a suitable depth under the waterbed, typically approx. 70 metres. In the description that follows the waterbed will be referred to as the seabed, even if the above seabed may equally well be the bottom of e.g. a lake, a river, a delta or a swamp area.

After the drilling of the above pilot hole the drilling tools and the drill string are pulled out of the pilot hole. A string composed of several connected conductor casings, i.e. a conductor casing string, is thereupon lowered down into the pilot hole by means of an installation string of drill pipes connected to the conductor casing string. Then floating cement (cement grout) is pumped down through and out of the bottom of the installation string and the conductor casing string, so that the cement grout is displaced up into the tubular space between the pilot hole and the conductor casing string. The conductor casing string must then be held in a preferably vertical position until the cement grout is sufficiently hardened, and thus has achieved a load carrying strength, which is sufficient for supplying the conductor casing string with necessary lateral support during later strains.

To facilitate the installation of the conductor casing, a guide base is connected to the conductor casing string's upper end. Seen from above the guide base normally has a rectangular shape, and each of the four corners of the guide base is fitted with a guide post with the objective of being an anchoring point for an appurtenant guide line. Each of the four guide lines of the guide base runs at all times to the surface. The conductor casing string, the guide base and the guide lines are then lowered down towards the seabed where the conductor casing string is guided into the lead hole, so that the guide base eventually is placed in an upper sedimentary layer in the seabed, and where this layer is normally made up of loosely composed and finely grained sedimentary particles as well as water, a mixture often referred to as mud. In this connection the lead base must be placed as vertically as possible down into the seabed.

After the location of the guide base on and in the seabed and after the cementing of the conductor casing string in the pilot hole has been done, one may, if desired, lower down a drill string, a casing string, a riser string or other necessary equipment, as such equipment is guided into position at the well centre line by means of the above guide lines, connected to the guide base.

As an alternative to the guide base's above guide lines, the guide base may be equipped with a funnel shaped sleeve, which is not described in greater detail, but in which such a sleeve has proved to be more suitable when working with wells at great sea depths.

In the use of known technique a guide base does not function as a load carrying construction in the founding of the well. Such loads typically consist of both pressure and torsion forces created by the weight of a blow out valve, well heads, casing strings in the well and other related equipment, as well as lateral forces caused to the blow out valve and/or the riser string by ocean streams, or as a result of the drift of a floating drilling installation. These loads are taken up by the conductor casing string, which therefore must be dimensioned accordingly, to avoid bending and breaking.

DISADVANTAGE OF KNOWN TECHNIQUE

The known substructure devices are encumbered with some disadvantages concerning strength and costs.

The drilling of a pilot hole as described above, and in which the drilling is done in loosely composed and substantially water filled waterbed sediments, often leads to great washouts of the wall of the pilot hole, and the greatest washouts often take place in the upper part of the lead hole.

By subsequent cementing of the conductor casing string, one will often achieve an unsatisfactory filling of cement grout in the expanded tubular space between the wall of the conductor casing string and the pilot hole. After the cement grout is hardened in the tubular space, this may lead to the load carrying conductor casing string getting an unsatisfactory lateral support for the above loads. Moreover, the hardened cement grout acts as a safety pressure barrier for possible outflows of e.g. gas in underlying shallow layers of the base formations, and an unsatisfactory cementing can weaken or eliminate this pressure barrier. In addition, large amounts of cement grout are required for the cementing of a conductor casing string, and the volume increases according to the degree of washing out that has taken place during the drilling of the pilot hole.

The method of first drilling a pilot hole, for then to cement a conductor casing string, may also lead to an unfortunate or unacceptable vertical deviation on the installed conductor casing string, either due to the pilot hole being drilled obliquely down into the seabed, or because the conductor casing string is not kept sufficiently immobile within an acceptable vertical deviation during the time needed for the cement grout to develop sufficient rigidity for supporting the conductor casing string. The drilling of pilot holes and the following cementing of the conductor casing string is further complicated when in deep water locations. This has to do with both the conductor casing string being affected by ocean streams and as a consequence of possible drift of a floating drilling installation, but also as a consequence of low seabed temperatures, which may lead to an extremely long hardening period for the cement grout.

The method of first drilling a pilot hole for then to cement a conductor casing string is in this context the main problem, and this method is in addition time consuming and expensive as the work i.a. must be performed with a drilling rig.

SUMMARY OF THE INVENTION

The present invention makes available a substructure device in the shape of a suction substructure having the necessary capacities and constructive features making it possible to pre-install the suction substructure, and at least one conductor casing string, using other and possibly smaller vessels than the present installation vessels, i.e. a suitable boat, and by piling technique. Thus, most of the above mentioned disadvantages are reduced or avoided.

How the Object is Achieved

According to the invention suction substructure is used prior to the installation of one or more conductor casing strings for the drilling of one or more underwater wells, preferably petroleum wells. The suction substructure and the conductor casing string(s) is/are installed from an installation device or installation vessel, e.g. a suitable boat, located on the surface, hereinafter only referred to as installation vessel.

The suction substructure is made up of e.g. a cylinder shaped substructure body whose shape has features resembling a cup or a glass, and which consist of an encompassing vertical part, or mantle, and where the substructure body at one end consists of an open part, which part in the operating position constitutes the bottom of the substructure body, and where the substructure body in the other and upper end, with the exception of a preferably circular opening, preferably consists of a closed horizontal part, e.g. a horizontal lid part, and where the substructure body otherwise is joined in a pressure sealing manner, e.g. by welding.

The above mentioned opening in the horizontal part, hereinafter referred to as guide opening, is surrounded by a conical guide funnel, joined to the substructure body in a pressure sealing manner, e.g. by welding, being external and overlying, preferably circular, having its maximum diameter in the upper end part. Thus, when applied on the seabed the guide funnel is suited to receive and centre a conductor casing string to have it forwarded into the suction substructure and down into the seabed sediments. The guide funnel may be shaped with an outer part, in relation to the substructure body, and a co-operating inner part, respectively an outer and upper guide funnel part as well as an inner and lower guide funnel part, and where the two guide funnel parts are preferably shaped in an interconnected fashion in the substructure body. The lower guide funnel part may alternatively be shaped with a continued cone in relation to the upper guide funnel part, so that the outlet diameter of the lower guide funnel part at the bottom end constitutes the smallest or largest diameter of the guide funnel, or where the lower guide funnel part is tubular with a constant diameter, or where this guide funnel part is shaped in another suitable way with regard to the actual conditions, e.g. ocean depths, with which one is working.

Alternatively, it is possible to fit the suction substructure with several guide funnels, and in which the shape of the suction substructure must be adapted to the number of guide funnels and their mutual positions, and in which the suction substructure, seen in plane drawing, may be given a rectangular or other non-circular shape. This may be opportune in the setting of more conductor casing strings, so called batch setting, e.g. in connection with the drilling of a number of production or/and injection wells in an oil field.

Besides, the inner part of the substructure body will due to strength and possibly construction considerations have to be fitted with partitioning walls.

In the installation of the suction substructure the upper end part of the guide funnel, or, possibly, the upper end parts of the guide funnels, must be fitted with a lid or a similar device which is releasable and pressure sealing, e.g. by way of suitable washers lid or the like. A lid is attached to the upper end part of the guide funnel by means of a releasable fastening device, e.g. a screwing or clamping device, and where the releasable fastening device preferably is released by the use of a remotely operated submarine vessel ("ROV").

The lid, or at least one of the lids, must also be fitted with a through bore in which an outlet pipe or a suitable outlet hose is connected to the outer side of the suction substructure, and where the outlet pipe/outlet hose on this outer side is connected to a pump. The lid/lids, the outlet pipe/outlet hose and the pump must otherwise be arranged to the substructure body e.g. by means of flanges, couplings, valves, seals or other necessary devices or equipment. In the case where the guide funnel as mentioned above is shaped with one outer and upper guide funnel part, as well as one inner and lower guide funnel part, which in operating position runs totally, or almost totally, to the open bottom part of the substructure body, and where the two guide funnel parts in addition are joined in a continuous and pressure sealing manner to the substructure body, one may in an upper part of the enclosing vertical part or upper horizontal part of the substructure body, but outside the guide funnel parts, equip the substructure body with a through bore in which an outlet pipe or a suitable outlet hose is connected on the outer side of the suction substructure, and where the outlet pipe or the outlet hose on this outer side is connected to a pump.

When in use, the installation vessel lowers the substructure body down to the chosen location on the seabed, e.g. by means of a suitable installation line which may be connected to a suitable number of lifting devices or similar fastening devices on the substructure body and via a suitable releasable lifting device or similar lifting device. When the substructure body thus is brought into contact with the seabed sediments, and where these normally appear in the shape of mud, the substructure body's downwards open end part is by virtue of the substructure body's own weight pressed some way down into the soft and water filled seabed sediments. Simultaneously and later in the installation process an adjusted vertical and upwards pressure is maintained in the installation line, so that the substructure body is kept in a nearly vertical position and within a given vertical tolerance deviation. The maintenance of the desired vertical position of the substructure body may e.g. be monitored by a remotely operated submarine vessel. By preference the same vessel is then connected to the above mentioned pump, as the vessel is fitted with the necessary connection devices, equipment and remedies for carrying out this and the subsequent tasks. From this vessel the pump is then activated in such a way that the water located inside the substructure body is pumped out, or sucked out of the substructure body, and thus the name suction substructure follows. This pumping out of water leads to the creation of a lower pressure inside the substructure body, in relation to the surrounding water and its hydrostatic pressure, and to the substructure body thus being pressed down into the mud, so that the substructure body is anchored to and in the seabed. It may be necessary in this connection to make the installation process in several steps, and in which the remotely operated submarine vessel during the installation is used for controlling that the suction substructure, which may be fitted with the required visual measuring equipment, is pressed as vertically as possible down into the seabed and within the desired vertical setting clearance for the substructure, and that the substructure is pressed adequately deep into the seabed sediments. Prior to the installation of the suction substructure one has preferably collected seabed sediment samples, so that one may determine the necessary penetration depth of the substructure body in the seabed sediments.

Then, possibly, the releasable and pressure sealing lid/lids from the guide funnel(s) of the suction substructure are coupled, so that the guide funnel(s) then are open for the later installation of guide pipes. In the following description it will, for the sake of simplicity, be referred to a suction substructure with only one guide funnel.

A conductor casing string is then lowered down from the installation vessel on the surface to the suction substructure and its guide funnel. During the lowering, the conductor casing string is guided towards and to the guide funnel of the suction substructure, preferably by means of the dynamic positioning device(s) of the installation vessel in co-operation with a submarine vessel, which performs visual underwater observations of the conductor casing string's position in relation to the suction substructure. If suitable, and in accordance with known technique, the conductor casing string may be guided towards and to the guide funnel of the suction substructure by means of guidelines, which are adapted and fastened to the suction substructure. The lower part of the conductor casing string is called a conductor casing string shoe, in which one in this connection preferably has mounted a piling hammer and a piling spear. The conductor casing string shoe, the piling hammer and the piling spear are positioned vertically above, and are then inserted into the mentioned guide funnel until the piling spear is brought into contact with the seabed, whereupon the piling spear as a consequence of the conductor casing string's own weight penetrates down into the seabed mud, so called autopenetration. In this way the conductor casing string is kept in place and the required lateral support and stability is secured in this position. To achieve the best possible vertical steering of the conductor casing string through the suction substructure, a constant outer diameter of the conductor casing string is sought, so that the smallest diameter of the guide funnel must exceed the conductor casing string's outer diameter to a sufficient degree, so that the conductor casing string during installation may pass freely through the guide funnel, but where the smallest diameter of the guide funnel at the same time is sufficiently small to be able to give the conductor casing string the required lateral support during installation and piling, as well as the necessary lateral support of the conductor casing string by later use of it as anchoring point for e.g. a wellhead.

The installation of a suction substructure according to the invention renders possible a conductor casing installation by means of known piling technique. In connection with the coupling of the conductor casings, and before the conductor casing string is lowered down to the suction substructure, one on the conductor casing shoe internally effective and e.g. hydraulically activated piling hammer is installed in the conductor casing string, which also is equipped with necessary control hoses, power supply hoses and other equipment necessary in this connection. After the conductor casing string thus, as described above, is guided into place in the suction substructure and the conductor casing shoe has penetrated the upper layer of the sea bed mud, the conductor casing string is driven by means of the described hydraulically activated pile hammer down into the seabed sediments to the desired depth, and so that the upper end of the conductor casing string extends sufficiently over the suction substructure, upon which the pile hammer is disconnected and lifted to the surface together with the accompanying hoses and equipment. If the upper end of the conductor casing string extends too much over the seabed, one may by means of a remotely operated submarine vessel cut the surplus length of the conductor casing to the desired length over the suction substructure, and the surplus pipe length may then be hoisted up to the installation vessel.

By means of the suction substructure and the method for installing it on and in a seabed, one has rendered possible installation of conductor casing down to an optimal setting depth, at the same time as the seabed sediments, which due to the piling surround the conductor casing, has become somewhat compressed, and where the conductor casings thereafter do not contain loose sediments or other obstacles, e.g. rests of cement grout, and where the conductor casing string extends with a desired length over the suction substructure, in which the surplus length is optimally adapted to the specific well requirements.

Advantages

By using the present invention one achieves being able to use known piling technique for driving the conductor casing string(s) approximately vertically down into the seabed, which may be performed by using a smaller installation vessel than e.g. a drilling rig, which is typically used in known conductor casing installation.

The installation of a suction substructure in combination with piling of conductor casing is remarkable due to the fact that this combination in relation to known conductor casing installation has a good ability to absorb the horizontally and vertically effective forces/loads as described above, and where the suction substructure as opposed to known guide frame installation also contributes to the absorption of such forces/loads.

The piling of conductor casing, as opposed to the drilling of holes and the subsequent cementing of the conductor casing, also leads to minimal disturbances to the seabed sediments which have been penetrated in the piling, leading to optimal collusion between seabed sediments and conductor casing. Such an installation also prevents the washing out of seabed sediments under the substructure during the subsequent through drilling of the installed conductor casing string. Such a washing out is a usual problem in the use of known technique for installation of conductor casing. Moreover, it will not be necessary in the piling of conductor casing(s) to cement the conductor casing string(s) after the piling of it/these has/have been performed.

In addition to the advantages in construction, one may through the pre-installation of conductor casing according to the invention achieve considerable economic benefits, as one as described may use other and smaller installation vessels than e.g. a drilling rig, and where one simultaneously achieves a more attractive conductor casing installation, seen from a security point of view. As a consequence of the piling of the conductor casing string(s) and the fact that the conductor casing string(s) in this way receives better lateral support, it will now be possible to have part of the horizontal forces loads, which in known technique are absorbed by the conductor casings, absorbed by the seabed sediments. Thus, as a consequence of the use of the suction substructure, one may dimension the conductor casing for lesser torsion and breaking loads, and thus apply smaller conductor casing dimensions, which also reduces the conductor casing costs in the drilling of an underwater well.

The use of the present invention, in which the conductor casing string extends with a desired surplus length over the suction substructure also renders possible an installation which is secure in terms of strength and suitable, of a wellhead on the mentioned conductor casing string, in that the well head in relation to known installation technique may be installed in greater distance over the seabed. This means i.a. easier access for an underwater vessel to the suction substructure and e.g. a wellhead, but as well that drilled out drill hole fragments, or cuttings, are not gathered in an unwanted height over the seabed around the suction substructure, thus creating operating problems, by the fact that one in an early phase of the drilling of the well dumps the cuttings on the seabed around the substructure.

BRIEF DESCRIPTION OF THE DRAWINGS

In the following part of the description, it will be referred to different and not-limited executions of the invention, with reference to the FIGS. 1–5, in which one certain number of reference refers to the same detail in all drawings where this detail occurs, and where.

DETAILED DESCRIPTION OF THE PREFERRED EMBODIMENTS

Equipment and/or arrangement which do not directly apply to the invention itself, but which still are necessary prerequisites for the operation of the invention are not more closely defined or described in detail in the following operating examples. Such equipment and/or arrangement includes e.g. surface vessels, submarine vessels, hoisting equipment, guide lines, pipes and hoses, couplings, valves, pumps, control equipment and possibly other necessary equipment or devices. This is well-known equipment for a person qualified in the field.

Figure 1:
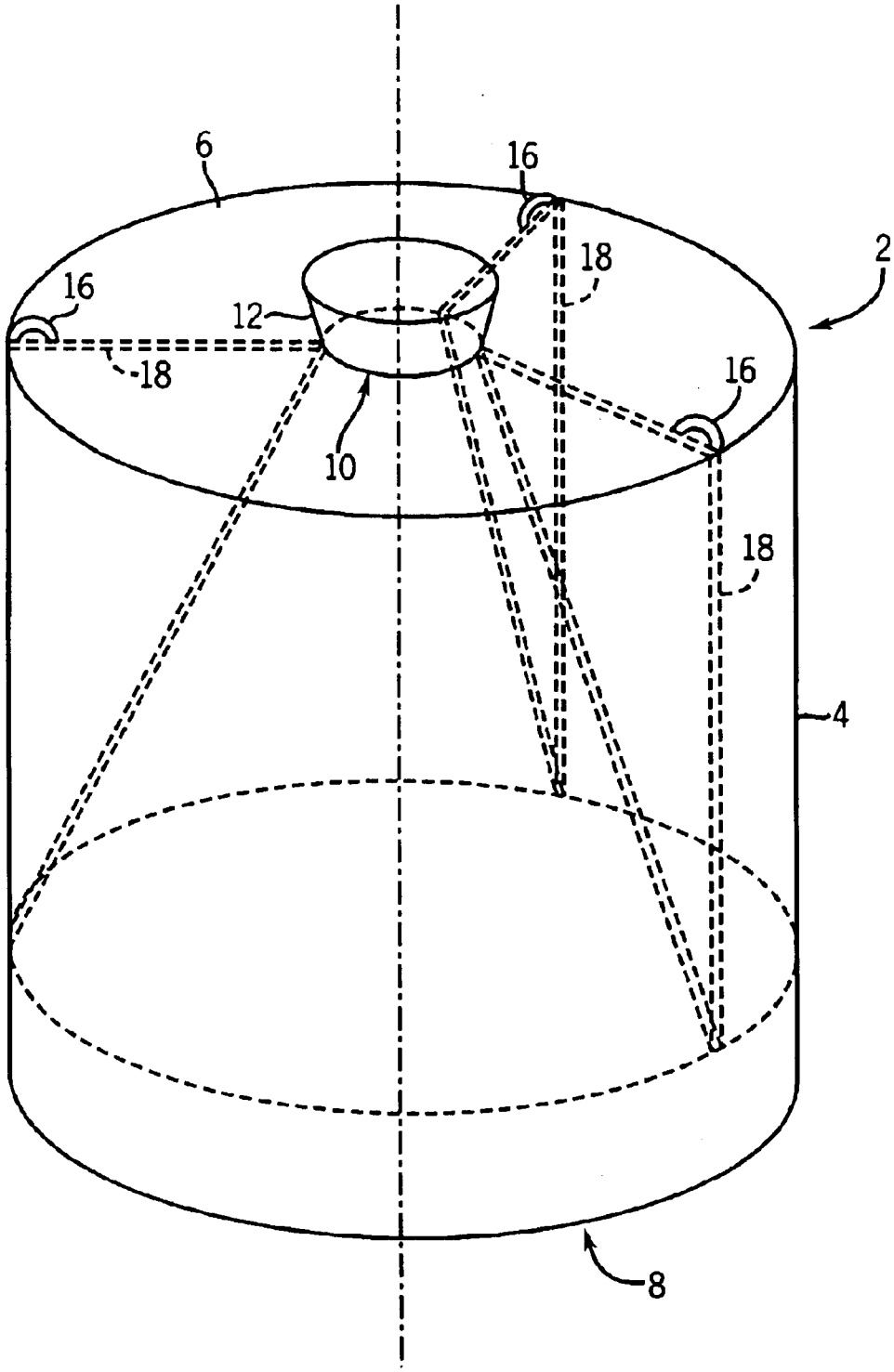
FIG. 1 shows a perspective view of a cylinder shaped suction substructure, in which the upper end of the suction substructure is shaped with a horizontal part being equipped with one around the centre line of the substructure body positioned circular guide opening surrounded by an outer cylindrically shaped and conical guide funnel, having its largest diameter in the upper end part, and where the cylinder shaped substructure body otherwise is joined together in a pressure sealing manner, e.g. by welding.
Figure 2:
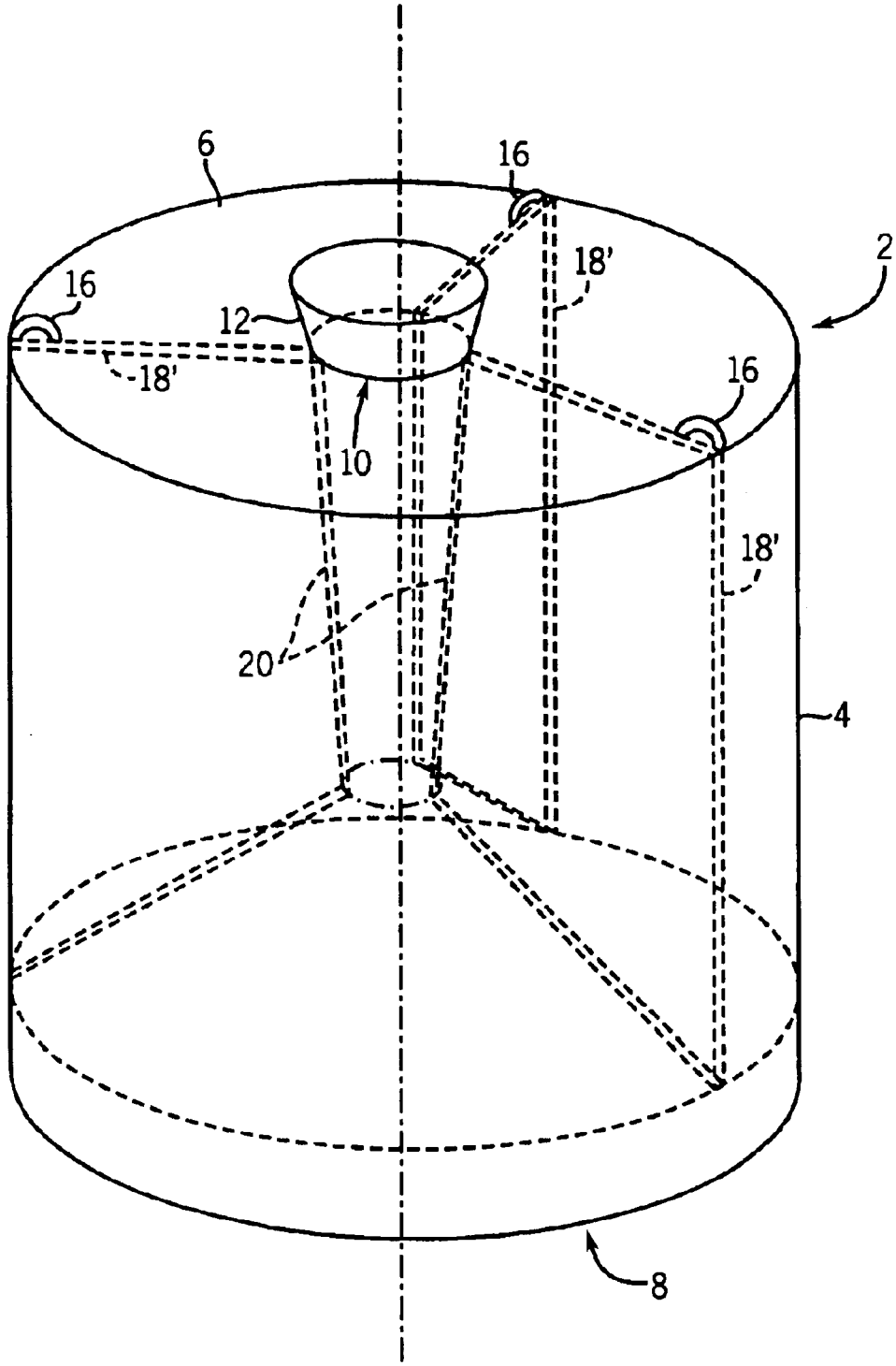
FIG. 2 shows a view in perspective of the same suction substructure as shown in FIG. 1, but where the guide funnel is shaped having an upper and outer guide funnel part and a lower and inner guide funnel part, and where the two guide funnel parts are jointly shaped centrally in the substructure body. The lower guide funnel part is shaped with an in relation to the upper guide funnel part extended cone, so that the outlet diameter of the lower guide funnel part constitutes the smallest diameter of the guide funnel.

FIG. 1 and FIG. 2 show a suction substructure 2 formed of a cylinder shaped and encompassing vertical part/mantle 4 being joined in a pressure sealing manner, e.g. by welding, having an upper circular horizontal part/lid part 6, and where the suction substructure 2 is shaped with one in the operating position open end part 8 in the lower end of the suction substructure 2. The lid part 6 is shaped with a through-going guide opening 10, to which guide opening 10 an outer and preferably circular guide funnel 12, hereinafter referred to as an outer and upper guide funnel part 12, is formed in a pressure sealing manner, e.g. by welding. The intention of the guide funnel 12 is i.a. to facilitate the introduction of a conductor casing string 14 in the suction substructure 2, but the guide funnel 12 is also equipped to supply lateral support and direction stability in the subsequent piling of the conductor casing string 14. In all the drawing figures the suction substructure 2 is externally equipped with three lifting airs 16. In the same way an inner part of the suction substructure is for reasons of strength in this example equipped with three supporting walls 18 (FIG. 1) and 18' (FIG. 2), radially positioned in relation to the centre line of the suction substructure 2. The suction substructure 2 according to FIG. 2 is externally identical to the suction substructure 2 according to FIG. 1. In FIG. 2 the suction substructure 2 is in addition fitted with an inner and lower guide funnel part 20, as the guide funnel parts 12 and 20 are continuously arranged to the suction substructure 2. The lower guide funnel part 20 is conical, so that the diameter of the lower guide funnel part 20 in the lowest lying position of the operating position constitutes the smallest diameter of the guide funnel part 20. Such a shape may e.g. be well suited for conditions requiring a lengthier support (stiffening) of the guide pipe.

Figure 3:
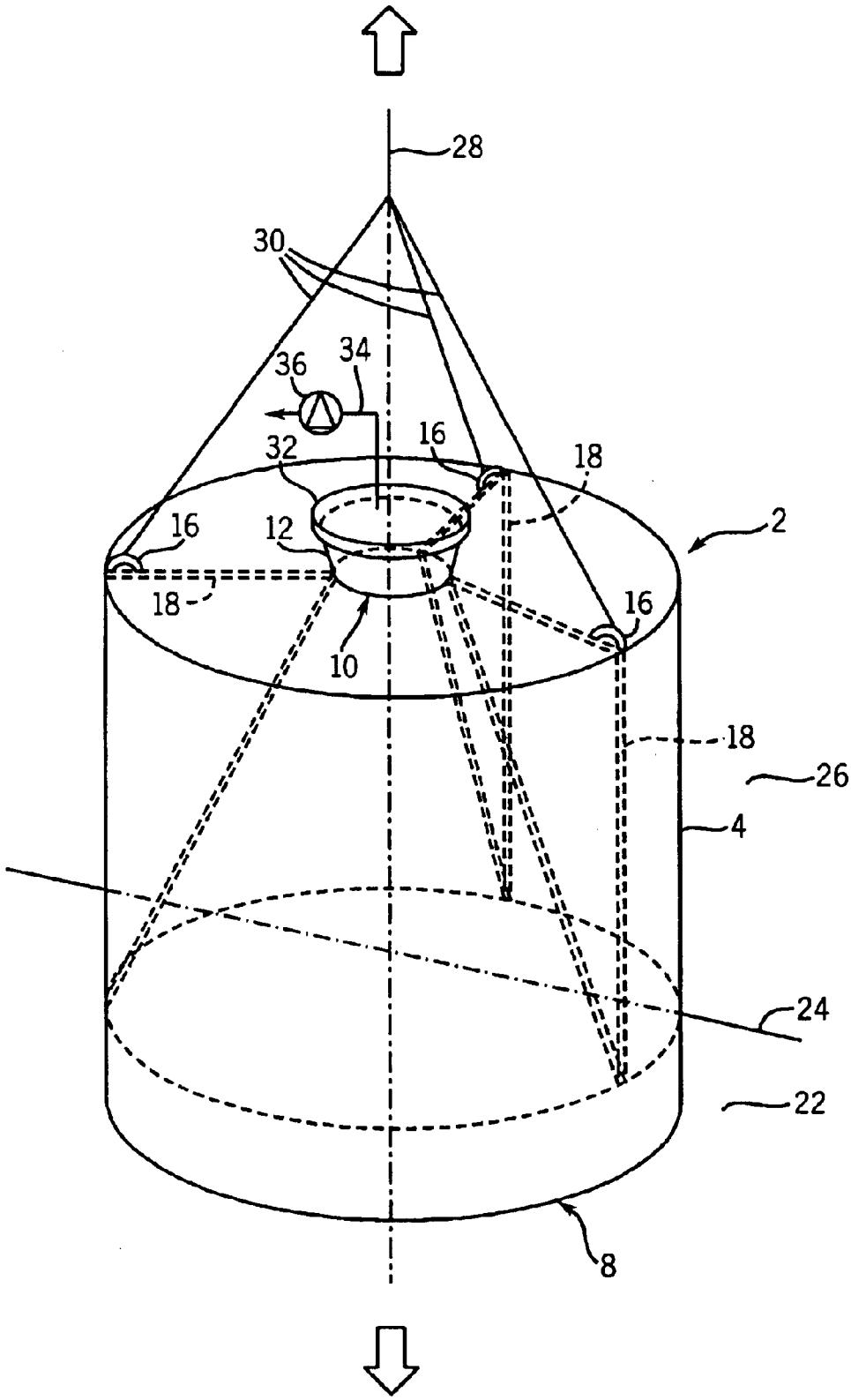
FIG. 3 shows a perspective view of the suction substructure according to FIG. 1, in which the lower open part of the substructure body is being pressed down into the seabed sediments.

In FIG. 3 the suction substructure 2 according to FIG. 1 is about to be pressed down into soft and water filled sediments 22 under a sloping seabed 24, having overlying seawater 26. In this situation the suction substructure 2 is connected to a surface vessel, not shown in the drawings, by means of an installation line 28 and a lower three armed lifting straddles 30 which is connected to the lifting ears 16 of the suction substructure 2. The guide funnel 12 of the suction substructure 2 is closed in the upper open end with a releasable lid 32, which is pressure sealing around its circumference, said lid 32 is fitted with a through outlet pipe 34 which is coupled to an external pump 36. The lid 32 is arranged to the guide funnel 12 in a pressure sealing manner by means of washers, not shown in the drawings, situated between the lid 32 and the guide funnel 12. The lid 32 is also fitted to the guide funnel by means of a releasable fastening device, not shown in the drawings, e.g. a screwing or clamping device, and where the releasable fastening device preferably is removed by a remotely operated underwater vessel, not shown in the drawings. After the suction substructure 2 has been lowered from the surface vessel and via the installation line 28 and the lifting straddle 30 down to, and as a consequence of the net weight of the suction substructure 2 has been partly pressed down into the sediments 22 under the waterbed 24, a certain tension is maintained in the installation line 28. The direction for the tension force is indicated in FIG. 3 by an upwards pointing arrow. At the same time one uses e.g. a remotely operated underwater vessel, not shown in the drawings, which is guided to and coupled to the pump 36, whereupon suited equipment on the underwater vessel runs the pump 36 so that seawater 26 is pumped out of the suction substructure 2. The outlet direction of the seawater 26 is indicated in FIG. 3 and by the pump 36 by a horizontal arrow. The mentioned pumping out of seawater 26 causes the internal fluid pressure of the suction substructure 2 to be lowered, so that a pressure differential between this pressure and the hydrostatic pressure of the seawater 26 surrounding the suction substructure 2, so that the suction substructure 2 thus is supplied with a downwards pressure force pressing the suction substructure 2 down into the seabed sediments 22. The direction of this pressure force is indicated in FIG. 3 by an arrow pointing downwards. To be able to install the suction substructure 2 as vertical as possible and on and in the seabed 24, a vertically upwards tension force is maintained in the installation line 28, being inferior to the downwards pressure force. The suction substructure 2 will in practice be fitted with suitable measuring equipment, not shown in the drawings, by which the vertical position of the suction substructure 2 may be checked, e.g. by means of a remotely operated underwater vessel, and where a vertical adjustment of the suction substructure 2 is performed by the mutual adaptation, possibly by steps, of the above mentioned forces in relation to each other, so that the suction substructure 2 is left standing in an approximately vertical position on and in the seabed 24.

Figure 4:
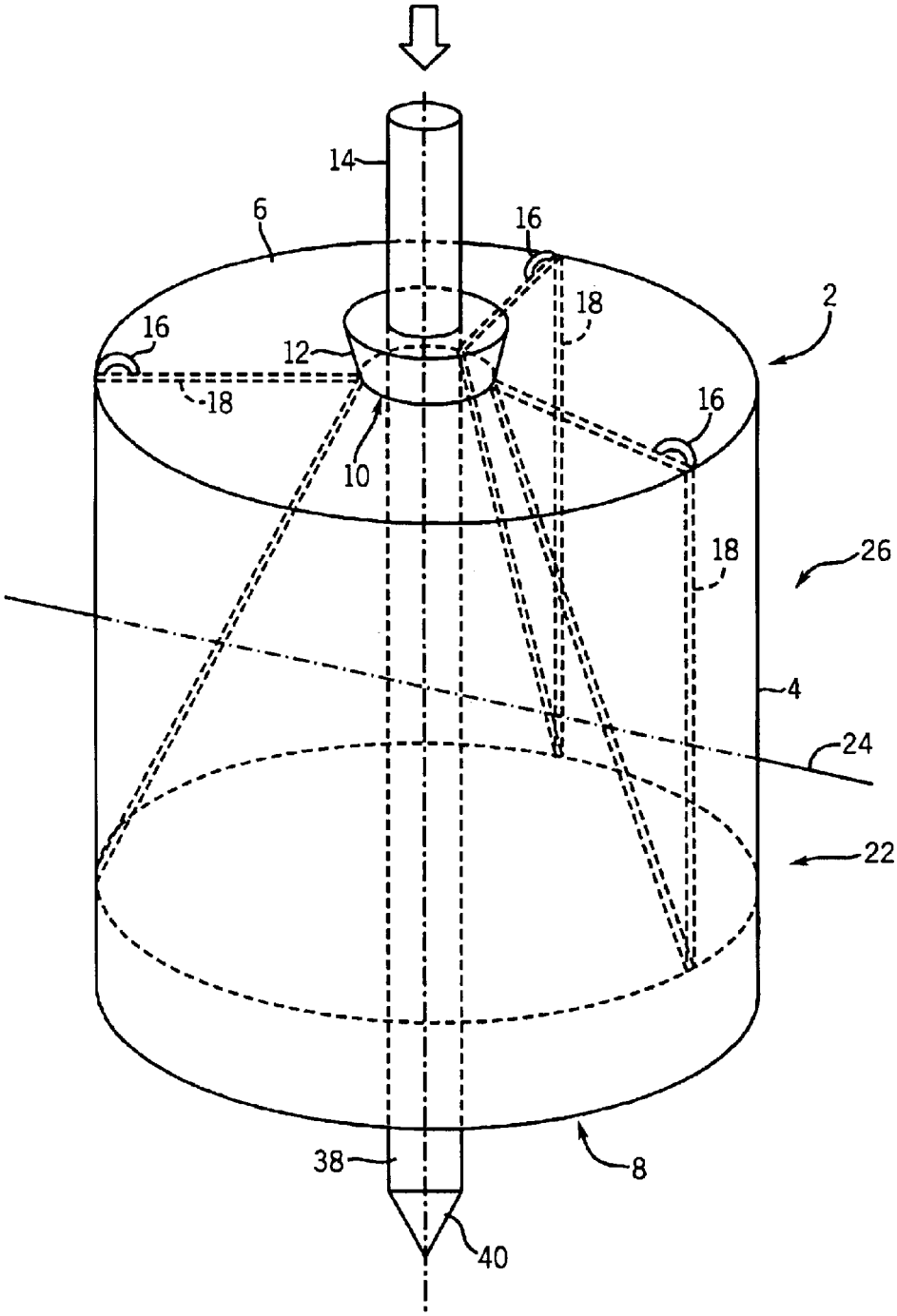
FIG. 4 shows a view in perspective of a suction substructure according to FIG. 1, but where the substructure is shown fully installed on and in the seabed, and where a section of the lower part of a conductor casing string is shown positioned in the guide funnel of the suction substructure and in the seabed sediments, as the conductor casing string is being piled down into the seabed; and where

As shown in FIG. 4, and after the completed installation of the suction substructure 2, the conductor casing string 14 is lowered, preferably by means of accurate positioning of the installation vessel, combined with the visual observation of the underwater vessel, down and through the guide funnel 12, so that the conductor casing string 14 is brought into contact with one, in the example, sloping seabed 24, and thereafter, as a consequence of its own weight is pressed some way down into the seabed sediments 22 and is left standing in an approximately vertical position therein. Then, one uses, according to known technique, e.g. an hydraulically operated piling hammer, not shown in the drawings, for ramming the conductor casing string 14 further down to a planned depth in the seabed sediments 22. The installation of the conductor casing string 14 by means of piling is rendered more efficient by the use of a piling hammer, not shown in the drawings, with a piling spear, in the lower end of the conductor casing string 14, or in the conductor casing shoe 38 of the conductor casing string 14, as the piling spear 40 leads to a reduction of the penetration resistance between the conductor casing string 14 and the seabed sediments 22.

Figure 5:
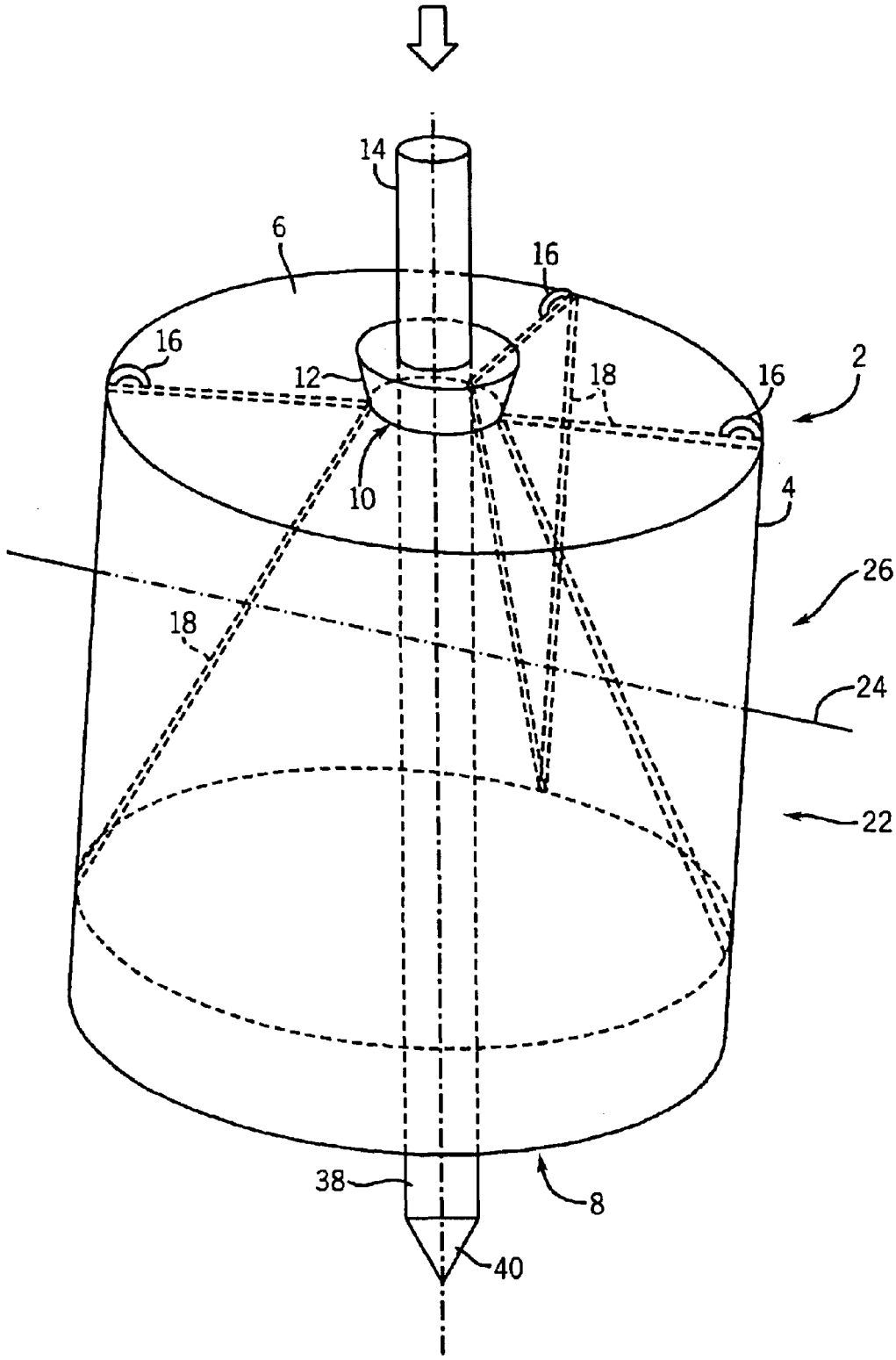
FIG. 5 shows a view in perspective of the suction substructure according to FIG. 1 and FIG. 4 and where the suction substructure is shown after installation in and on the seabed, but where the vertical part/mantle of the suction substructure, as opposed to in FIG. 4, is positioned with a substantial vertical deviation on and in the seabed.

FIG. 5 shows, in relation to FIG. 3 and FIG. 4 the same installation of the suction substructure 2 and the conductor casing string 14 on and in a sloping seabed 24, but where the vertical part/mantle 4 of the suction substructure (2) in FIG. 5 is shown arranged in the operating position having a substantial vertical deviation in relation to the suction substructure shown in FIG. 4. Such a vertical deviation may e.g. occur due to a sloping seabed 24 and/or e.g. as a consequence of the fact that the sediments 22, of which the seabed consists, not having a uniform consistency in relation to each other, a fact that may cause uneven pressing-in of the suction substructure 2. The resulting vertical deviation does still not prevent vertical introduction of the conductor casing string 14 through the guide funnel 12, and that the conductor casing string 14 thereupon may be piled further down into the seabed sediments 22.

What is claimed is:

1. A method for piling a conductor casing string (14) into sediments (22) of a waterbed (24) by using a floating installation vessel, the installation vessel being provided with means for practicing said method, said means including hoisting equipment, cables, conduits for power supply and equipment control, connections and fittings, valves, pumping means and control equipment, said piling method requiring that the interior of the conductor casing string (14), at the lower end and casing shoe (38) thereof, be provided with a releasable piling hammer, and a cooperating piling spear (40), said conductor casing shoe (38) and piling spear (40) also being provided with force-transmitting striking surfaces, onto which surfaces said piling hammer repeatedly exerts its impact force and drives the conductor casing string (14) into the waterbed (24) during the piling operation, wherein the method is initiated by lowering into water (26) from said floating installation vessel a suction substructure (2) which is installed onto and within the sediments (22) of the waterbed (24), the suction substructure (2) providing necessary and stabilizing lateral support for the conductor casing string (14) during its installation in the sediments (22), hence making possible to install by means of piling the upper end of the conductor casing string (14) as vertical as possible, and within a small vertical tolerance, within said sediments (22) of the waterbed (24), and wherein the suction substructure (2), in order to achieve said verticality, is provided with a supporting mantle (4), an upper lid part (6) and a downwards open part (8) which, due to the weight of the suction substructure (2), is pressed some distance into the sediments (22) when being lowered therein, the lid part (6) being provided with at least one through-going guide opening (10) which upon said lowering is connected in a pressure sealing manner to an associated, releasable lid (32), the suction substructure (2) also being provided with an outlet conduit (34) connected to a pump (36) which then is activated and pumps the water (26) out of the suction substructure (2), thus pressing the suction substructure (2) further into the sediments (22) of the waterbed (24), whereupon the releasable lid (32) is removed from the guide opening (10) or, alternatively, from at least one guide opening (10), the suction substructure (2) thus being prepared for the subsequent piling of the conductor casing string (14), characterized in that the method comprises, in sequence, the following steps:

a) lowering the conductor casing string (14) containing the piling hammer and the cooperating piling spear (40) into water (26) and down to the suction substructure (2), the conductor casing string (14) being lowered on an installation line (28) connected to the floating installation vessel;

b) guiding, while hanging down from the installation line (28), the piling spear (40) and a lower part of the conductor casing string (14) through the guide opening (10) in the suction substructure (2), and then lowering them down towards the sediments (22) and, due to the weight of the conductor casing string (14), pressing them some distance into said sediments (22), the guide opening (10) thereby providing said stabilizing lateral support for the conductor casing string (14) during its installation in the sediments (22) of the waterbed (24);

c) initiating the piling of the conductor casing string (14) by supplying the piling hammer with necessary motive power through a conduit from the floating installation vessel, the piling hammer thereby driving the piling spear (40) and the conductor casing string (14) down to a desired depth within the sediments (22), the entire piled length of conductor casing string (14) thereinafter adhering to the surrounding sediments (22), hence providing the conductor casing string (14) with optimum lateral stabilizing support and associated optimum load-supporting properties, the suction substructure (2), when in position of use, also providing the conductor casing string (14) with an upper anchoring or clamping point which substantially increases the load-carrying capacity of the conductor casing string (14) with respect to bending and buckling caused by subsequent well loads exerted onto the conductor casing string (14), including the weight of a wellhead and a blowout preventer; and d) disconnecting and removing downhole piling equipment, including the piling hammer and the piling spear (40), from the conductor casing string (14), thus completing the installation of the conductor casing string (14) in the sediments (22) of the waterbed (24), hence enabling subsequent drilling of an underwater well to be initiated through the piled conductor casing string (14).

2. A method according to claim 1, further characterized in step c) as driving the piling spear (40) and the conductor casing string (14) down to a depth within the sediments (22) which allows an upper end portion of the conductor casing string (14) to project above the suction substructure (2) on the waterbed (24), thus allowing the wellhead and/or the blowout preventer to be mounted on top of the conductor casing string (14).

3. A method for piling an elongated conductor casing string into a bed of sediments lying under water, the method comprising the steps of:

lowering a suction substructure into the water and onto the sediments, the suction substructure comprising a supporting mantle, an upper lid part and a downward open part, the downward open part being forced into the sediments by the weight of the suction substructure, the upper lid part provided with at least one through-going guide opening which upon lowering is connected in a pressure sealing manner to a releasable lid, the suction substructure further comprising an outlet conduit connected to a pump;

activating the pump to pump water from the suction substructure, thereby creating a suction force that forces the suction substructure further into the sediments;

removing the releasable lid from the at least one through-going guide opening;

lowering the elongated conductor casing string into the water and down to the suction substructure;

guiding a lower end of the elongated conductor casing string through the guide opening and into the sediments, wherein the guide opening provides stabilizing lateral support for the elongated conductor casing string; and piling the conductor casing string to a desired depth into the sediments.

4. The method of claim 3, wherein, as a result of the piling, the entire length of the elongated conductor casing string adheres to the sediments, thereby providing the elongated conductor casing string with optimum lateral stabilizing support and associated optimum load-supporting properties.

5. The method of claim 3, wherein, as a result of the guiding of the conductor casing string, the suction substructure provides the elongated conductor casing string with an upper anchoring or clamping point which increases the load carrying capacity of the conductor casing string with respect to bending and buckling caused by subsequent well loads exerted onto the conductor casing string, the well loads comprising the weight of a wellhead and a blowout preventer.

6. The method of claim 3, wherein the lower end of the elongated conductor casing string comprises a piling spear for piling the conductor casing string into the sediments.

7. The method of claim 6, wherein the piling spear and the elongated conductor casing string are piled down to the desired depth within the sediments by a piling hammer through a conduit from an installation vessel.

8. The method of claim 7 further comprising the step of:

uncoupling and removing the piling hammer and piling spear from the elongated conductor casing string, thus completing the installation of the elongated conductor casing string in the sediments and enabling subsequent drilling of an underwater well to be initiated through the installed elongated conductor casing string.

9. The method of claim 3, wherein after piling the elongated conductor casing string into the sediments, an upper end of the elongated conductor casing string projects above the suction substrate, thus allowing a well head or blowout preventer to be mounted to an upper end of the elongated conductor casing string.

* * * * *